US011178991B2

(12) United States Patent
Dobin et al.

(10) Patent No.: US 11,178,991 B2
(45) Date of Patent: Nov. 23, 2021

(54) DECORATIVE MOUNT FOR ATTACHING TO A CEILING OR WALL

(71) Applicant: Valley Forge Fabrics, Inc., Fort Lauderdale, FL (US)

(72) Inventors: J Michael Dobin, Fort Lauderdale, FL (US); Michael Handler, Walpole, MA (US)

( * ) Notice: Subject to any disclaimer, the term of this patent is extended or adjusted under 35 U.S.C. 154(b) by 373 days.

(21) Appl. No.: 16/052,703

(22) Filed: Aug. 2, 2018

(65) Prior Publication Data

US 2020/0037803 A1 Feb. 6, 2020

(51) Int. Cl.
*A47H 1/06* (2006.01)
*E06B 9/323* (2006.01)
*A47H 99/00* (2009.01)

(52) U.S. Cl.
CPC ..... *A47H 1/06* (2013.01); *A47H 99/00* (2013.01); *E06B 9/323* (2013.01)

(58) Field of Classification Search
CPC ..... A47H 1/04; A47H 2001/042; A47H 1/06; A47H 99/00; A47H 15/04; A47H 1/10; E06B 2009/587; E06B 9/323; E06B 9/36; E06B 2009/588
See application file for complete search history.

(56) References Cited

U.S. PATENT DOCUMENTS 3,076,222 A * 2/1963 Sloan ..... A47H 1/06 16/98
RE26,269 E * 9/1967 Ford ..... E05D 15/0626 160/346
4,103,463 A * 8/1978 Dixon ..... E04B 2/824 52/126.4
4,406,436 A * 9/1983 Benthin ..... A47H 1/124 248/262
7,743,557 B2 * 6/2010 Liao ..... E05D 15/0652 49/409
7,832,454 B2 * 11/2010 Lyons ..... E04H 4/06 160/368.1
2009/0050280 A1 * 2/2009 Morris ..... A47H 23/04 160/345
2010/0095615 A1 * 4/2010 Houle ..... E04B 2/7448 52/264

(Continued)

FOREIGN PATENT DOCUMENTS

DE 1988-243356 * 2/1987
DE 2013-W32816 * 8/2012

(Continued)

*Primary Examiner* — Daniel P Cahn
(74) *Attorney, Agent, or Firm* — Derek Fahey; The Plus IP Firm

(57) ABSTRACT

A decorative mount for attaching to a ceiling. The decorative mount includes a pair of opposing vertical members defining a first channel. A first opening is at a downward facing side of the first channel. The first channel is for receiving a plurality of carriers. A support cross member spans the vertical members above the first channel. A decorative surface is positioned on a frontward facing side of the decorative mount. A lip is horizontally aligned along the rearward facing top edge of the mount. The lip is integral with top of the mount and configured such that the lip attaches directly to the ceiling such that the decorative surface faces frontward.

13 Claims, 17 Drawing Sheets

(56) References Cited

U.S. PATENT DOCUMENTS

| | | | | |
|---|---|---|---|---|
| 2010/0218906 | A1* | 9/2010 | Marzilli | A47H 23/08 160/368.1 |
| 2011/0036521 | A1* | 2/2011 | Aebi | A47H 1/04 160/368.1 |
| 2016/0326800 | A1* | 11/2016 | Marocco | A47H 13/04 |
| 2016/0374496 | A1* | 12/2016 | Marcinik | A47H 1/08 160/331 |
| 2017/0002606 | A1* | 1/2017 | Yu | A47H 13/04 |

FOREIGN PATENT DOCUMENTS

| | | | |
|---|---|---|---|
| EP | 2003-315643 | * | 12/2002 |
| EP | 2012-J78704 | * | 1/2011 |
| EP | 2015-656627 | * | 4/2014 |
| GB | 1990-173549 | * | 12/1988 |

* cited by examiner

DECORATIVE MOUNT FOR ATTACHING TO A CEILING OR WALL

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates generally to the field of coverings for windows, doors, wall or the like. More specifically the present invention relates to the field of hardware related to said coverings.

BACKGROUND

For many years and in many different areas throughout the world, curtains and shades have been used to provide privacy, for decorative purposes and to prevent light from entering a room or area. People have been using hardware to attach the curtains and shades to walls and ceilings. Currently, the hardware used for mounting curtains and rods includes rods having channels or tracks. Carriers or sliders, which are attached to the top ends of the curtains or shades, are configured to translate within the channels of the rods.

Shades and curtains for the commercial and industrial purposes, such as for use in convention centers, large meeting spaces and hotels, tend to have larger dimensions and may weigh significantly more than for residential purposes. Many of the commercial type rods that are attached directly to the ceiling use fasteners that attach the top side of the rod directly to the ceiling. For example, U.S. Pat. No. 9,480,357 to Price et al. ("Price reference") teaches such a device. However, one problem with the rod taught by the Price reference is that it does not adequately block out light between the rod and uneven surfaces including popcorn, heavy textured and uneven ceilings.

Blocking light from entering a room is desirable for many reasons. For example, blocking light from entering the room is desirable for improved sleep and other activities that are best accomplished in the absence of light. Blocking light may also be desirable for privacy reasons and for providing a dark environment. Many devices for mounting and for use with curtains and shades are well known to those skilled in the art.

Another problem with curtain or shade rods used for commercial or industrial purposes, such as the rods disclosed in the Price reference, is that the rods are configured for attaching to only the ceiling or only to the wall proximate to the openings. This may be inefficient given that many times it may be more desirable to attach a rod to a wall instead of a ceiling and vice versa.

Another problem with curtain or shade rods used for commercial or industrial purposes, such as the rods disclosed in the Price reference, is that the frontward side of the rod that is visible, or observable, is not aesthetically pleasing. Additionally, the existing rods known to those skilled within the art is that those rods do not have a decorative forward side combined with a rod that may be easily installed directly to the ceiling having the strength to properly support curtain or shades and allow the carriers or slides to properly operate and translate within the channels of the rods.

As a result, there exists a need for improvements over the prior art and more particularly, better hardware for attaching curtains and shades to the ceiling and walls.

SUMMARY

A decorative mount is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a decorative mount for attaching to the ceiling or wall is disclosed. The decorative mount includes a pair of opposing vertical members defining a first channel. A first opening is at a downward facing side of the first channel. The first channel is for receiving a plurality of carriers. A support cross member connects the vertical members above the first channel A decorative surface is positioned on a frontward facing side of the decorative mount. A lip is horizontally aligned along the rearward facing top edge of the mount. The lip is integral with top of the mount and configured such that the lip attaches directly to the ceiling such that the decorative surface faces frontward.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
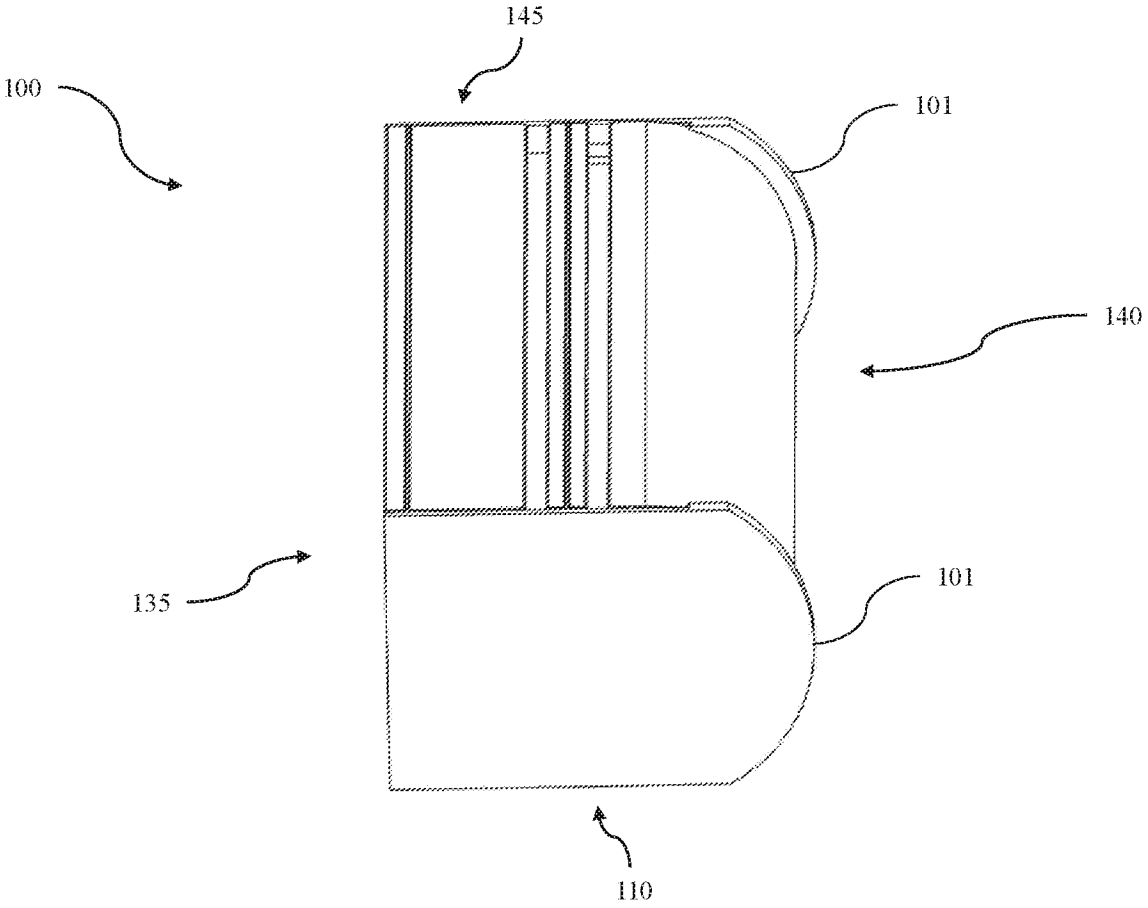
FIG. 1 is a first perspective view of a first decorative mount for attaching to a ceiling and wall mount, wherein end caps are attached to the ends and two channels are on the upward facing side of the mount, according to an embodiment of the present invention.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims. The disclosed embodiments improve upon the problems with the prior art by providing hardware that more efficiently prevents light leakage between the ceiling and the upward facing side of the mount or rod by having a channel configured for receiving an insulating strip along the upward facing side of the rod. The disclosed embodiments improve over the prior art by providing a lip for horizontally aligned along the rearward facing top edge, wherein the integral with top of the track and configured such that the lip attaches directly to the ceiling such that a decorative surface faces frontward. In certain embodiments, the present invention improves over the prior art by providing a second channel that is configured for receiving fasteners for attaching the rod or mount to a wall in addition to the lip that is for attaching the rod to the ceiling. The disclosed embodiments improve over the prior art by providing a cross member for providing an increased amount of strength to the rod. The present invention also decreases the amount of time required for installation given that decorative mount can be installed to the ceiling as a single unit. Additionally, in certain embodiments, the present invention may also be attached to a vertical wall by a bracket or wall mount. The present invention decreases the amount of parts required to mount the decorative mount to a ceiling or wall, which decreases costs required for installing the decorative mounts.

Figure 7:
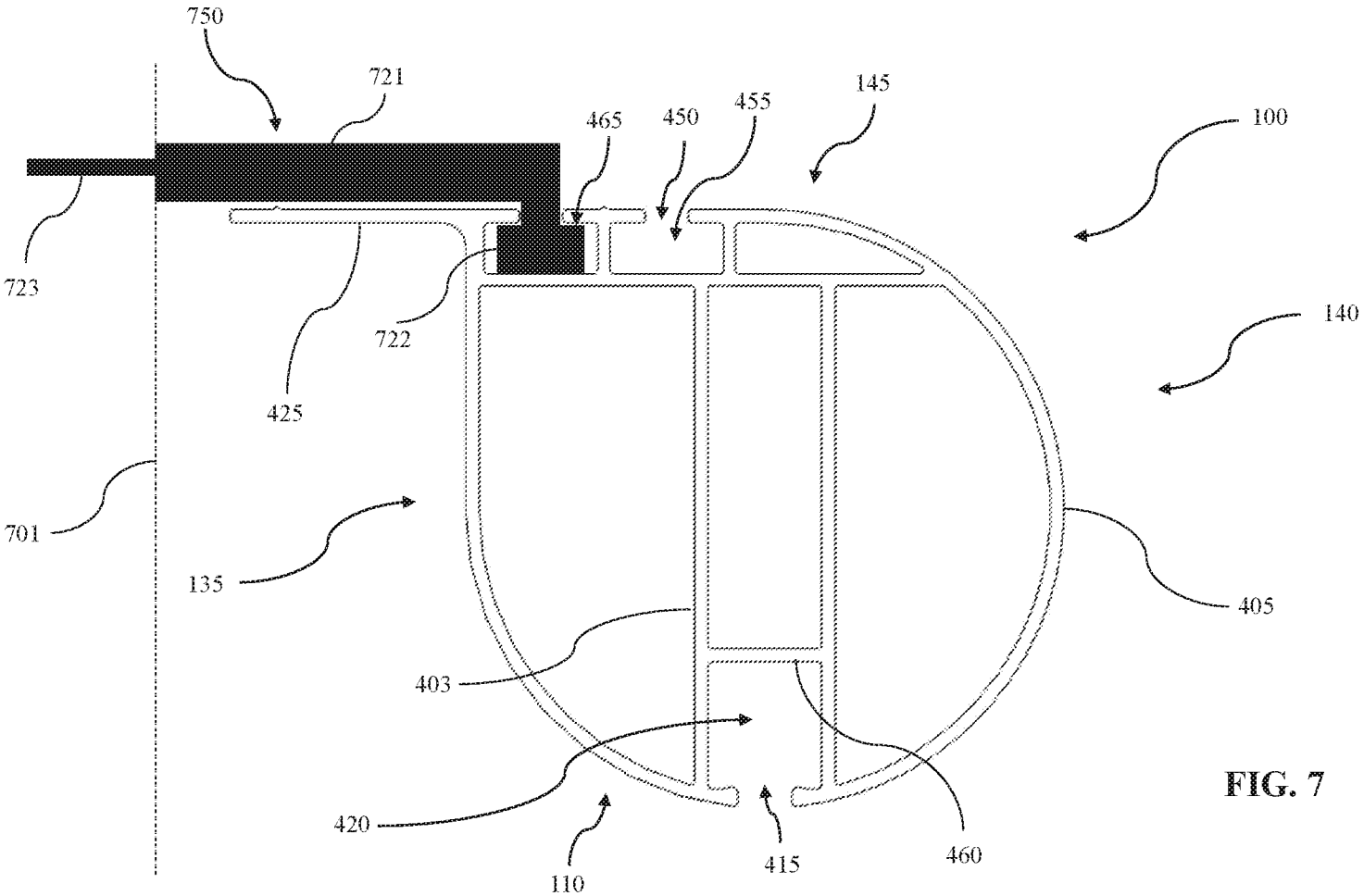
FIG. 7 is an end view of the first decorative mount attached to a wall by a bracket or wall mount, wherein the ends caps are removed, and a channel receives a part of the bracket that is attached to a vertical wall, according to an embodiment of the present invention.
Figure 8:
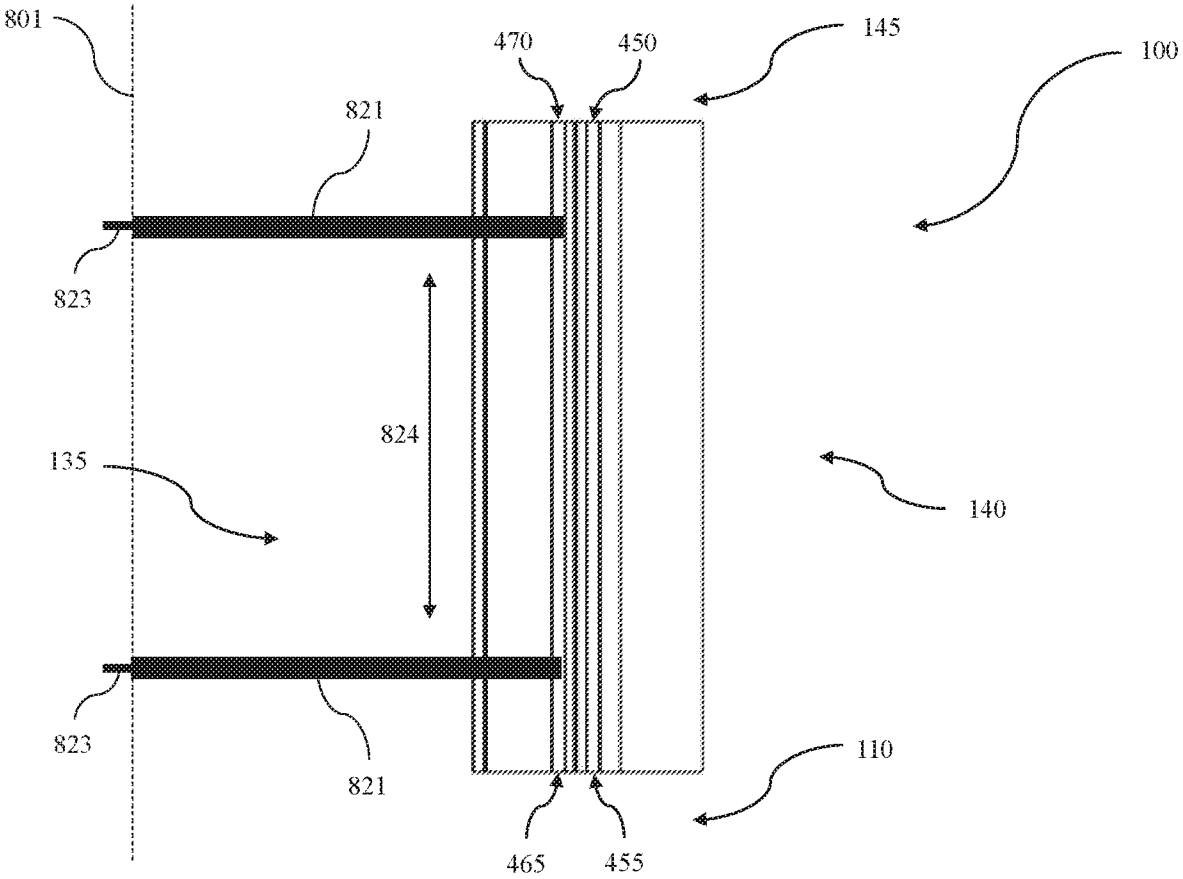
FIG. 8 is a top view of the first decorative attached to the wall by brackets or wall mount, wherein the end caps are removed, according to an embodiment of the present invention.

Referring now to the Figures, FIG. 1 illustrates a top perspective view of an embodiment of the decorative mount 100 for attaching to a ceiling and wall. The decorative mount is an elongated tubular shaped body comprising of a frontward facing side 140, rearward facing side 135, upward facing side 145, and downward facing side 110. It should be appreciated that the decorative mount can have any cross-sectional shape and can thereby be formed in a square, rectangular, circular, oval or any other cross-sectional shape, and such variations are within the spirit and scope of the claimed invention. The decorative mount may also be configured for attaching to a wall (further explained below and as illustrated in FIGS. 7 and 8). The decorative mount may be comprised of materials such as carbon steel, stainless steel, aluminum, titanium, other metals or alloys, composites, ceramics, polymeric materials such as polycarbonates, such as acrylonitrile butadiene styrene (ABS plastic), Lexan™, and Makrolon™. FIG. 1 illustrates two channels upward relative to the first channel (further explained below). The components of the hosing may be manufactured from a variety of different processes including via a CNC lathe, extrusion, a mold, welding, shearing, punching, welding, folding etc.

Both ends of the decorative mount are covered by an end cap 101. The end cap may comprise a generally planar shaped body and is attachable to the ends of the upward facing side and downward facing side of the decorative mount using a friction fit. The end cap may also comprise other features configured for attaching each cap to the end of the mount and for providing decorative elements. It is understood that the end caps may be held in place using any other suitable method known in the art, including adhesives, lips, snaps, set screws, screws, and clips. The end caps may be formed from the same material as the decorative mount, or they may be formed from another suitable material. Additionally, the end caps serve to contain a plurality of carriers within the first channel 220 (further explained below) and improve the aesthetic appearance of the decorative mount by concealing the internal members and channels of the decorative mount. The carriers to be described more fully below are meant to transport a curtain or other suspended item along the longitudinal first channel, wherein the carriers are slid axially into the first opening from an end thereof.

Figure 2:
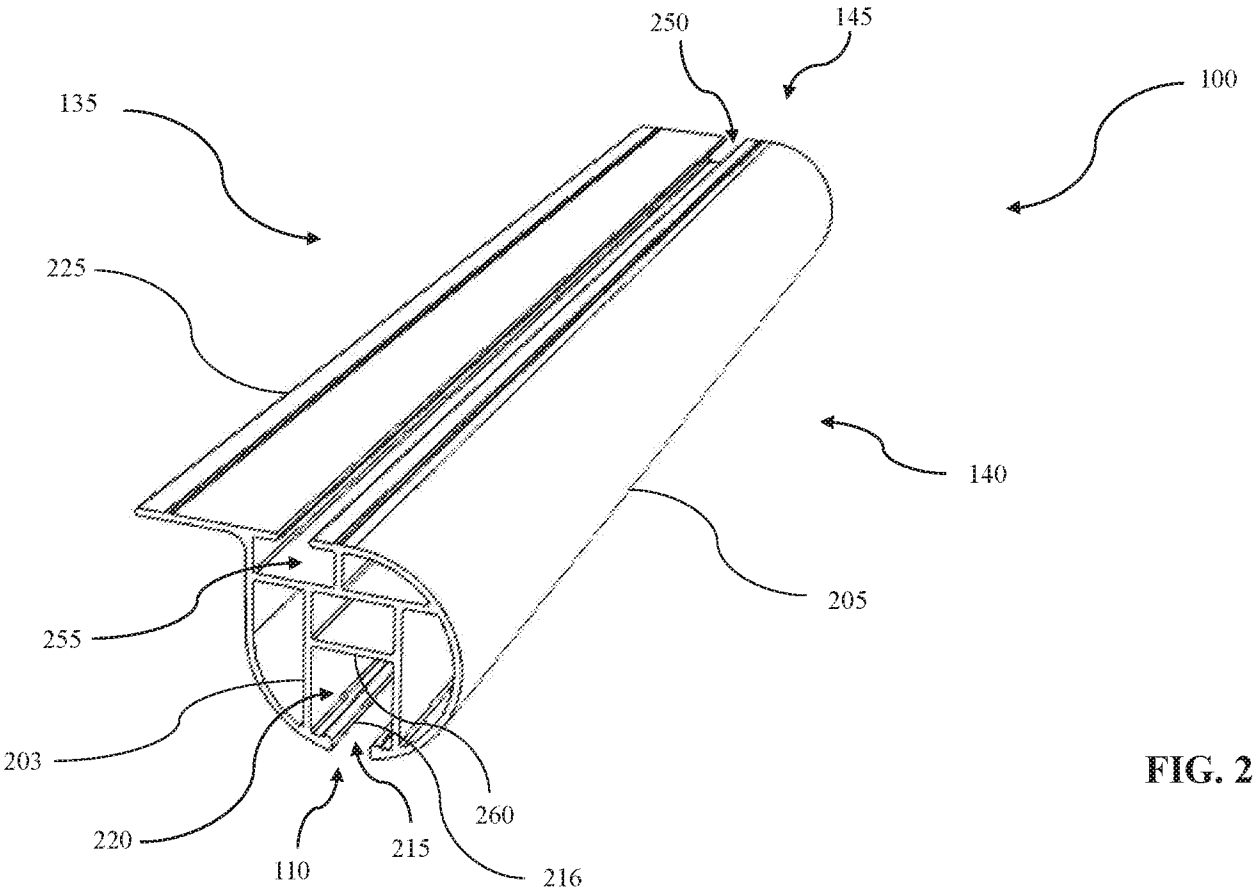
FIG. 2 is a perspective view of a second decorative mount for attaching to a ceiling and wall mount, wherein end caps are removed and a channel is on the upward facing side, and a channel is on the downward facing side, according to an embodiment of the present invention.
Figure 3:
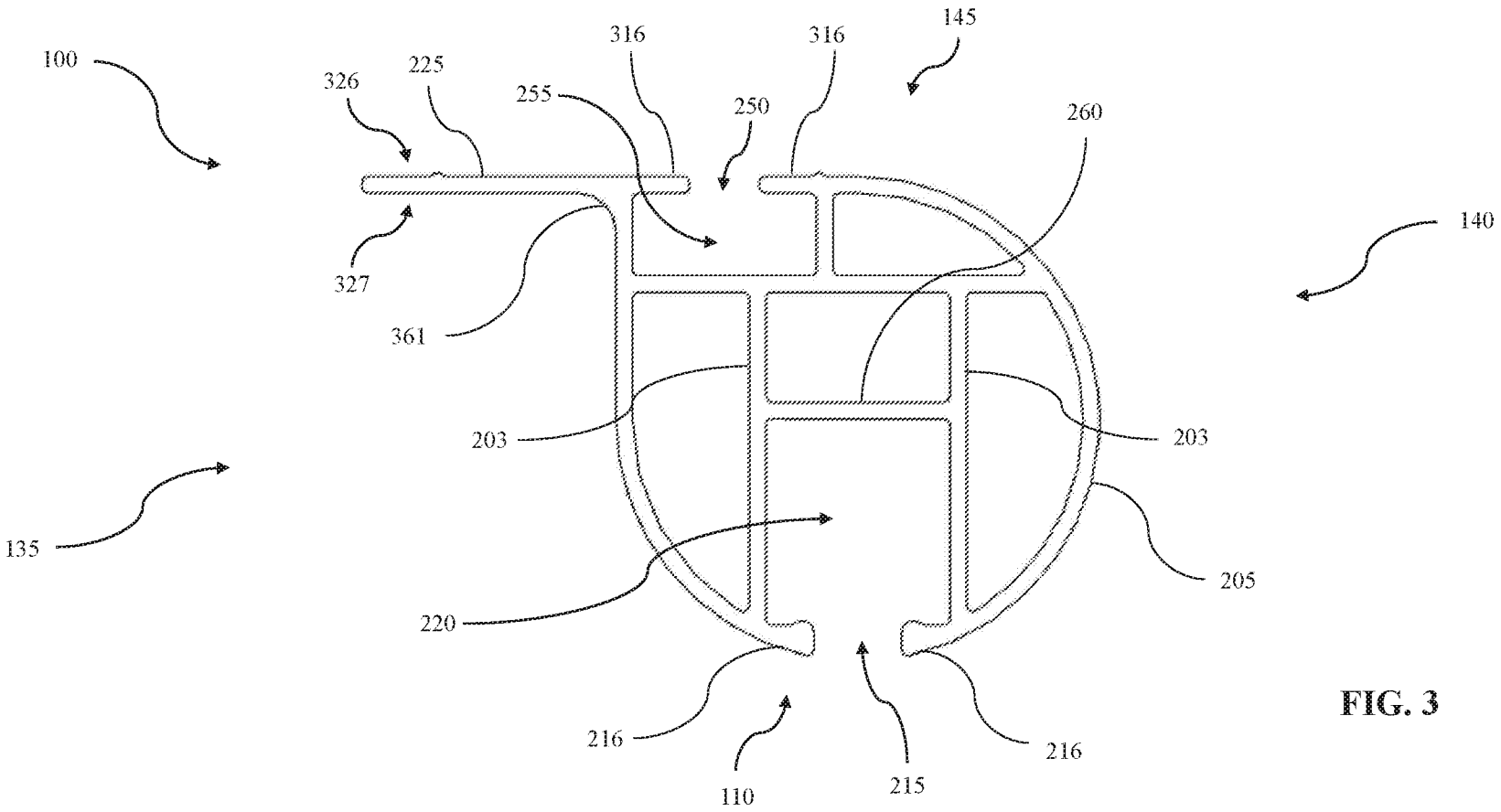
FIG. 3 is an end view of the second decorative mount for attaching to a ceiling and wall mount, wherein the ends caps are removed illustrating the internal members and channels of the second decorative mount, according to an embodiment of the present invention.

FIGS. 2 and 3 illustrate another embodiment of the present invention having a second channel upward relative to the first channel (further explained below). Additionally, FIGS. 2 and 3 show a pair of generally planar vertical members 203 that define the first channel 220 of the decorative mount. A generally planar horizontal cross member 260 spans from one vertical member to the other above the first channel and is integrated or configured to increase the amount of strength to the decorative mount. The vertical members and cross member are positioned inside the inner circumference of the decorative mount. The cross member is perpendicular to the vertical members and parallel to where the floor (not illustrated) would be positioned when the mount is attached to a ceiling or wall. While the cross member 260 is perpendicular to the vertical members, other angles may be used for the cross member to provide additional support and rigidity to the decorative mount. The combination of the vertical members with the cross member comprises an H-shaped frame. In other words, the vertical members provide the vertical portions of the "H" shape and the cross member provides the horizontal portion of the "H" shape. The vertical members and cross member define internal partitions that form a longitudinal first channel that extends along the entire length of the decorative mount. In the present embodiment, the vertical members and horizontal cross member extend along the entire length of the decorative mount. However, in other embodiments, the vertical members and horizontal cross member may not span the entire body of the mount. In the present embodiment, the vertical members and horizontal members may comprise planer elongated shaped bodies.

The first opening 215 is located on the downward facing side 110 of the first channel. In the present embodiment, the first opening defines a substantially rectangular shape that spans the entire length of the downward facing side of the first channel. However, in other embodiments, the first opening may not span the entire body of the mount. It should be appreciated that the shape of the opening is not limited to the embodiments shown in the figures, and that other shapes may also be used. The first opening is configured to allow the carriers that are attached to the upward end of coverings to translate along the entire length of the first channel.

In the present embodiment, the first channel spans the entire length of the decorative mount. The bottom end of the first channel includes two catching features 216 configured for receiving and holding a plurality of carriers that can suspend curtains, shades, or the like. In the present embodiment, each of the catching features is configured for receiving the roller or portion of the carrier that is configured for translating within the first channel. Each of the catching features comprises a raised portion or ridge that catches and prevents the carrier from translating traverse relative to the longitudinal axis of the mount. The longitudinal catching features of the first channel extend in a substantially parallel relationship to one another and define the substantially rectangular shape of the first opening. The width of each catching feature is smaller in relation to the width of the first opening to prevent the carriers that rest on the top of the catching features from falling through the first channel when the weight of a curtain or other suspended item pressures the carriers. The size and shape of each of the catching features may be adjusted depending on the application and a variety of other factors. For example, each of the catching features may be adjusted for the size of the carrier, size of curtain, length of mounts, etc.

The first channel allows an upper portion of the carrier (illustrated as 695 in FIG. 6) to be received within the first channel while the lower portion of the carrier remains external or below to the first channel. The carriers are inserted into the first channel and a curtain or other suspended item may be secured to the lower portion of the carrier that remains external to the first channel using corresponding attachment such as matching hook-and-loop fasteners, releasable clips, hooks and grommets, tape, chemical adhesives, screws, and magnets. In being supported by the carriers, a curtain or other suspended item is freely moveable along the catching features within the first channel. The first channel is configured to accommodate common carriers, such as wheeled carriers, which typically move more freely, or friction carriers, which slide along the catching features. In such a configuration, the carriers may be moved to a multitude of positions along the entire length of the first channel by a force exerted on the carrier by a user, or by any other means. The shape of the first opening may vary in size, and dimension and be proportioned to receive the popular carriers of the type found in home supply and drapery shops.

A decorative surface 205 is positioned on the frontward facing side of the decorative mount to improve the overall aesthetic appearance of the decorative mount. The shape of the decorative surface is not limited to the shapes depicted in the figures, such shapes may take other forms (See FIGS. 9-14), and such variations are within the spirit and scope of the claimed invention. As such, the decorative surface delivers a consistent and aesthetically-pleasing look by offering more visually appealing options to choose from that can be customized to individual tastes and designs, which overcomes the limitations that presently exist in the prior art. The decorative surface may be integral with the decorative mount or may be attached to the outward facing surface of the decorative mount. The decorative surface may comprise a variety of different materials so long as the lip is integral with remaining portions of the decorative mount. The decorative surface may comprise materials such as carbon steel, stainless steel, aluminum, titanium, other metals or alloys, composites, fiberglass, ceramics, polymeric materials such as polycarbonates, such as acrylonitrile butadiene styrene (ABS plastic), Lexan™, and Makrolon™. It is also understood, that it is within the spirit and scope of the present invention that the decorative surface may also comprise ornamental features, textures, finishes and designs.

The decorative mount contains a protruding lip 225 that is horizontally aligned along the top edge 361 of the rearward facing side of the decorative mount in a ninety degree, or right angle, configuration. The lip has a planar shaped body comprising a top side 326 and a bottom side 327. The lip is integral with the top edge of the decorative mount and configured such that the lip attaches directly to the ceiling (further explained below) and the decorative surface is in a forward facing position. The lip is integral which means that the lip may be part of the same unit as the decorative mount, or it may be formed from another suitable material.

In one embodiment, the decorative mount further comprises a second opening 250 on the upward facing side 145 of the second channel 255. The second opening defines a substantially rectangular shape that spans the entire length of the upward facing side of the second channel. It should be appreciated that the shape of the opening is not limited to the embodiments shown in the figures, and that other shapes may also be used.

The second channel is positioned upward relative to the first channel and has a U-shaped inner frame structure and a substantially square shaped body that spans the entire length of the decorative mount. The upward end of the second channel includes two horizontal catching features 316 configured to retain a first part of an insulating strip 615 or element (See FIG. 6) within the second channel. In the embodiment illustrated in the figures, the second channel is positioned such that the opening 250 is rearward relative to the first opening 215. In other embodiments, the second channel may be configured for receiving a bracket such that the decorative mount may also be attached to a vertical orientated structure, such as a wall (similar to how the bracket inserted into the third channel attaches the decorative mount to a vertical wall as illustrated in FIGS. 7 and 8) However, it is understood that in other embodiments, the position of the second opening relative to the first opening may be varied according to the application.

The longitudinal catching features of the second channel extend in a substantially parallel relationship to one another and define the substantially rectangular shape of the second opening. The width of each catching feature is smaller in relation to the width of the second opening to maintain a first part of an insulating strip in a snug position within the second channel. The insulating strip is configured for preventing light between the upward facing side of the decorative mount and the ceiling when the decorative mount is attached to the ceiling (further explained below). In other embodiments, the insulating elements may comprise of other elements that are configured for preventing light leakage between the upward facing surface of the decorative mount and the ceiling. In other embodiments, the second channel may be also configured for receiving a bracket (similar to the bracket illustrated in FIGS. 7 and 8) for attaching the decorative mount to a wall.

Figure 4:
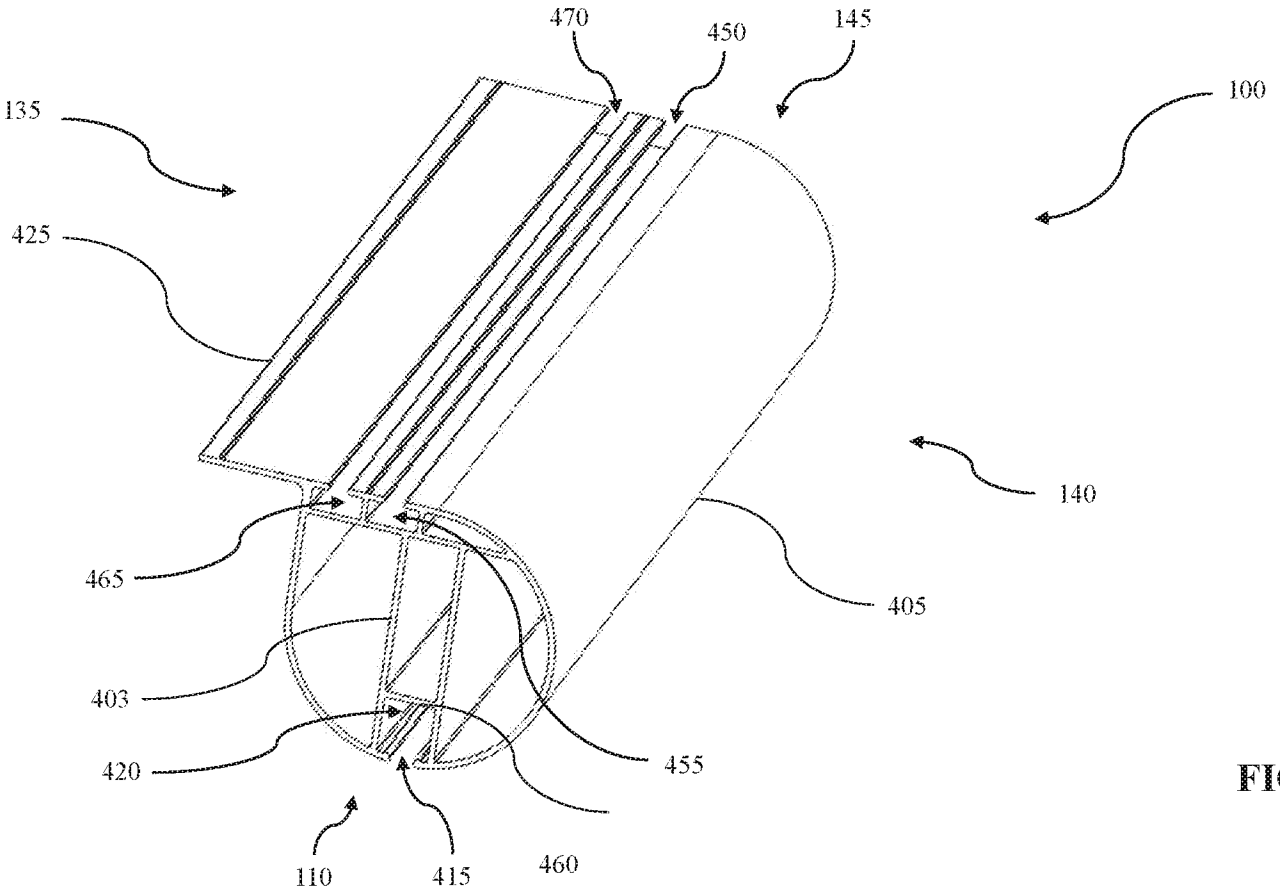
FIG. 4 is a second perspective view of the first decorative mount for attaching to a ceiling and wall mount, wherein the end caps are removed, and two channels are on the upward facing side, and a channel is on the downward facing side, according to an embodiment of the present invention.
Figure 5:
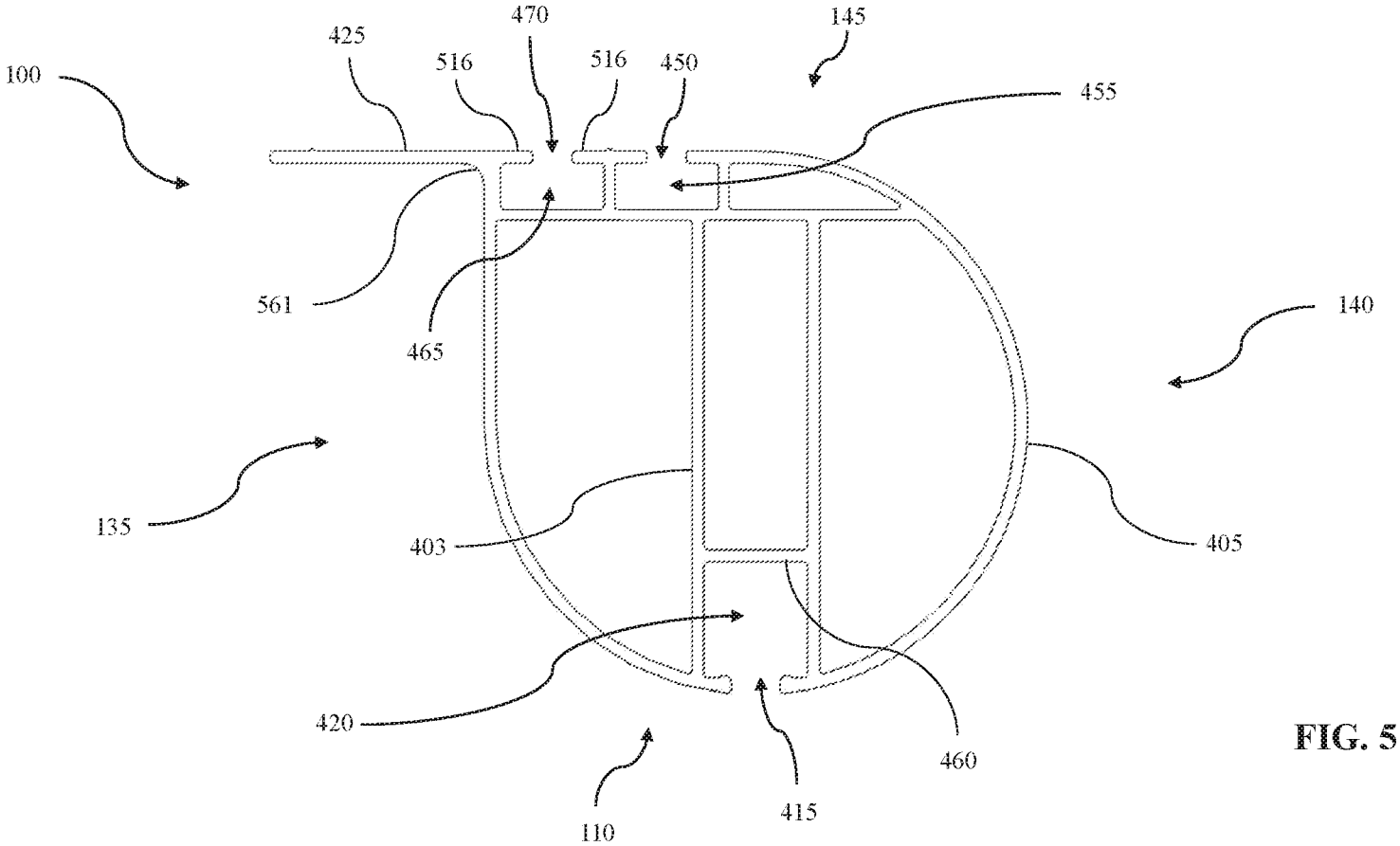
FIG. 5 is an end view of the first decorative mount for attaching to a ceiling and wall mount, wherein the ends caps are removed illustrating the internal members and channels of the decorative mount, according to an embodiment of the present invention.

FIGS. 4 and 5 illustrate another embodiment of the present invention that further includes another opening 470 on the upward facing side of the third channel 465. The third opening defines a substantially rectangular shape that spans the entire length of the upward facing side of the third channel. It should be appreciated that the shape of the opening is not limited to the embodiments shown in the figures, and that other shapes may also be used.

The third channel 465 is positioned upward relative to the first channel and rearward relative to the second channel. The third channel and opening define a U-shaped inner frame structure and a substantially square shaped body that spans the entire length of the decorative mount. The upward end of the third channel includes two horizontally oriented catching features 516 configured to receive and hold the second extension of a bracket 722 (further explained below) that is designed to attach the decorative mount to a vertical wall 701 (See FIG. 7). The longitudinal catching features of the third channel extend in a substantially parallel relationship to one another and define the substantially rectangular shape of the third opening. The width of each catching feature is smaller in relation to the width of the third opening to allow the second extension of a bracket to securely sustain the decorative mount to a vertical wall, as well as to prevent it from falling when the weight of the decorative mount, together with a curtain or other suspended item, pressures the second extension of a bracket.

Figure 6:
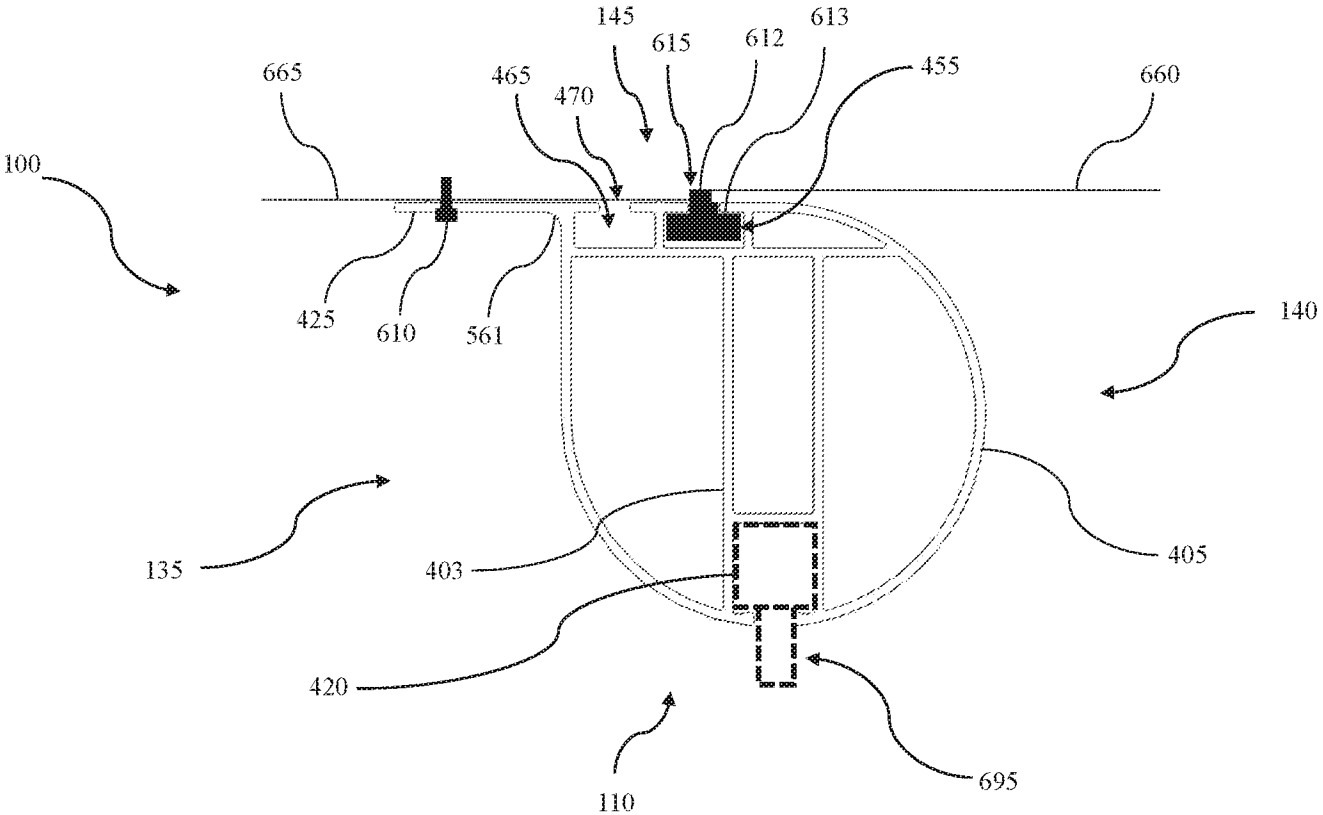
FIG. 6 is an end view of the first decorative mount for attaching to a ceiling and wall mount, wherein the ends caps are removed, and a lip aligned along the top edge of the rearward facing side of the mount is attached to an uneven ceiling surface and an insulating strip above the upward facing side of the decorative mount prevents light leakage, according to an embodiment of the present invention.

FIG. 6 is an end view of an embodiment of the present invention being installed to a heavy textured or uneven ceiling. FIG. 6 further illustrates a carrier 695 having an upper portion received by the first channel and a lower portion extending below the decorative mount. The lower portion of the carrier is configured for attaching to an upper end of a covering. As furthered described above, the carrier is configured to translate within the first channel such so that a user may move curtains and other blinds attached to the carriers between an open configuration and closed configuration. FIG. 6 also illustrates an uneven ceiling. In one embodiment, the uneven ceiling may comprise of a slightly lower 660 and slightly higher 665 horizontal surface. For example, in many older homes or commercial spaces, the surface of the ceilings may be uneven or nonplanar due to settling of the foundation, water damage, popcorn, cracks, or fishers. As a result, many devices for mounting and for use with curtains and shades will not adequately block out light when a ceiling has uneven surfaces. Light leakage into a room can be a significant issue for many hotels and other commercial businesses. Many hotels and commercial businesses demand zero light leakage into their accommodations and rooms because of guests that may require total darkness during daylight hours. For example, airline pilots, flight attendants and other travelers must be able to sleep during daylight hours and require total darkness which may be affected because of light leakage. Additionally, excessive or undesired light leakage may also be an issue for anyone trying to improve their sleep, for those who work at night and sleep in the day, or that live in areas that have extended periods of daylight. The present invention overcomes the shortcomings of the prior art by providing an insulating strip that prevents undesired light leakage due to the uneven surfaces.

The insulating strip is configured such that the upperpart 612 of the insulating strip abuts the ceiling to prevent light leakage between a heavy textured or uneven ceiling and the upward facing side of the decorative mount. The lower part 613 of the insulating strip 615 is configured for being received within the channel 455. The catching elements of the second channel are configured for preventing the insulating strip from being removed from the channel. In operation, a user may install the insulating strip by sliding the strip into the channel such that the upper end of the insulating strip extends out above the upward facing surface of the decorative mount. As shown in FIG. 6, the insulating strip passes through the second opening such that a second part of the insulating strip extends above the upward facing side of the decorative mount. The insulating strip is designed with a slightly reduced width in relation to the width of the second channel so that the insulating strip may be easily inserted into the second channel. In alternative embodiments, the insulating strip may be permanently fixed to the second channel, for example, by adhesive bonding or gluing. The insulating strip has light leakage prevention properties and may comprise of various types of flexible plastics, such as polyvinyl chloride, natural or synthetic rubber, foam, synthetic fabrics such as polyester filament, acrylic, nylon, rayon, lyocell, acetate, spandex, and Kevlar, and natural fabrics such as coir, cotton, hemp, jute, leather, linen, ramie, wool, silk, or any other suitable flexible natural or synthetic material including combinations of materials that prevents light leakage. Additionally, other elements or members may also be inserted into the second channel and used for preventing light leakage. However, it is understood that other materials may be used that are within the scope present invention.

Additionally, the design of the present invention facilitates a particularly convenient installation procedure. FIG. 6 shows the decorative mount secured to a ceiling or upper horizontal surface after driving a fastener through a hole on the lip. The lip is configured to receive fasteners 610 through a series of holes (not shown) placed at different intervals down the entire length of the lip, which are used to secure the decorative mount directly to the ceiling and prevent the decorative mount from moving or swaying. The fastener may be a screw if the opening is threaded, or may alternatively, comprise a nut and bolt combination if the opening is not threaded. In other embodiments, the insulating strip may be configured for being positioned within the third channel (470).

Figure 6A:
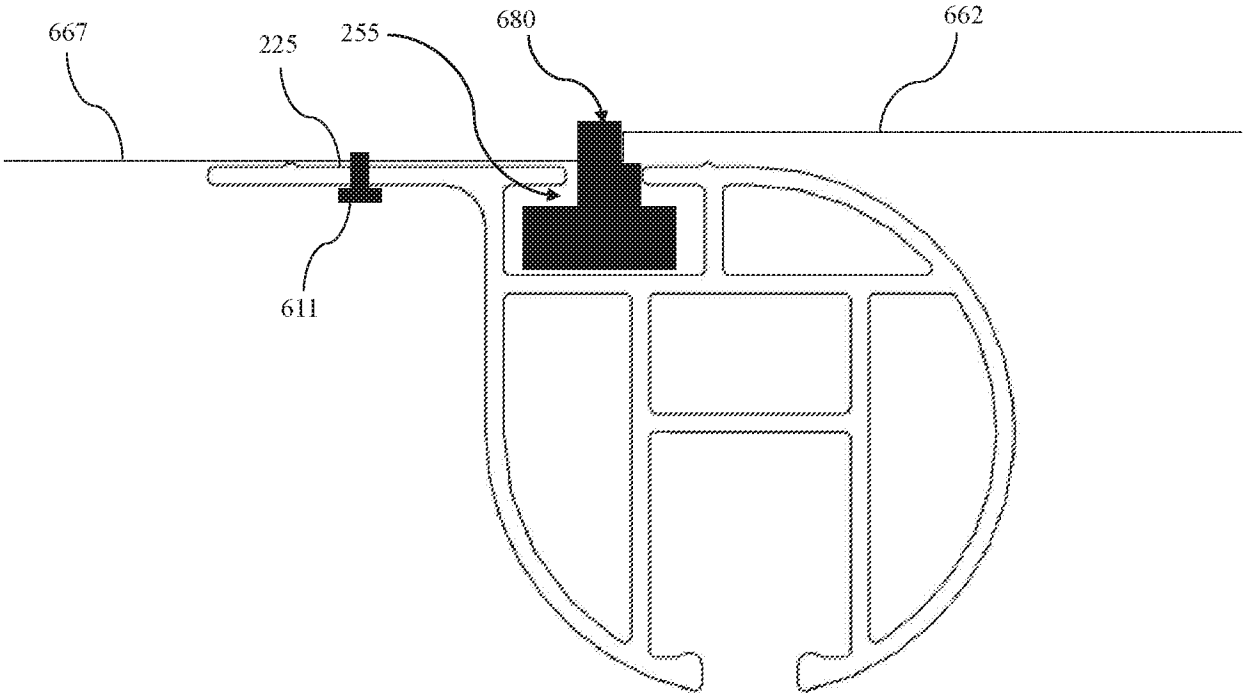
FIG. 6A is an end view of the second decorative mount for attaching to a ceiling and wall mount, wherein the ends caps are removed, and a lip aligned along the top edge of the rearward facing side of the mount is attached to an uneven ceiling surface and an insulating strip above the upward facing side of the decorative mount prevents light leakage, according to an embodiment of the present invention.

FIG. 6A is an end view of the second decorative mount mounted to an uneven ceiling at the lip 225 by a fastener 611. Similar to the FIG. 6, the uneven ceiling is defined by a lower surface 667 and a higher surface 662. The insulating strip 680 is configured such that the upperpart of the insulating strip abuts the ceiling to prevent light leakage between a heavy textured or uneven ceiling and the upward facing side of the decorative mount. The lower part of the insulating strip 615 is configured for being received within the channel 255. The catching elements of the channel 255 are configured for preventing the insulating strip from being removed from the channel. As mentioned above, in operation, a user may install the insulating strip by sliding the strip into the channel such that the upper end of the insulating strip extends out above the upward facing surface of the decorative mount. In alternative embodiments, the insulating strip may be permanently fixed to the second channel, for example, by adhesive bonding or gluing.

FIG. 7 is an end view of an embodiment of the present invention being installed on a vertical oriented wall 701 or surface. The design of the present invention facilitates another particularly convenient installation procedure requiring little or no skills. As an alternative to securing the decorative mount to a ceiling by driving a fastener through a hole on the lip, the decorative mount may also be secured to a vertical wall using a bracket or wall mount 750 which is slid into the third channel via the third opening. In other embodiments the bracket is configured for being received and slid into the second channel by a second opening. The size of the bracket may also be adjusted depending on the application. Beside the bracket may depend on the weight of the curtain, weight of the decorative mount, position of the decorative mount, whether the bracket is inserted into the second or third channel etc. The bracket comprises a first extension 721 and a second extension 722 that are perpendicular to one another other. The first extension of the bracket is arranged to be horizontally secured to the substantially vertical surface of a wall via a fastener 723, and the second extension of the bracket that is received by the third channel such that the decorative mount is secured to the substantially vertical surface of a wall. The vertical and horizontal extensions of the bracket can be any shape, length, or cross section desired.

FIG. 8 is a top to bottom view of an embodiment of the present invention installed to a vertical wall using two brackets. Here, the decorative mount is secured to a vertical wall 801 using two brackets that are received within the third channels. However, it is understood that in other embodiments the brackets may be received within the second channels where appropriate. The first extension 821 of each bracket is horizontally secured to the substantially vertical surface of the wall via a fastener 823, and the second extension of each bracket (not shown) is received within the third channel Depending on the overall length of the decorative mount, a bracket may be positioned every five feet within the third channel. However, depending on the application, the amounts of brackets used for securing the decorative mount to a vertical wall may be adjusted depending on a variety of other factors known to those skilled in the art.

Figure 8A:
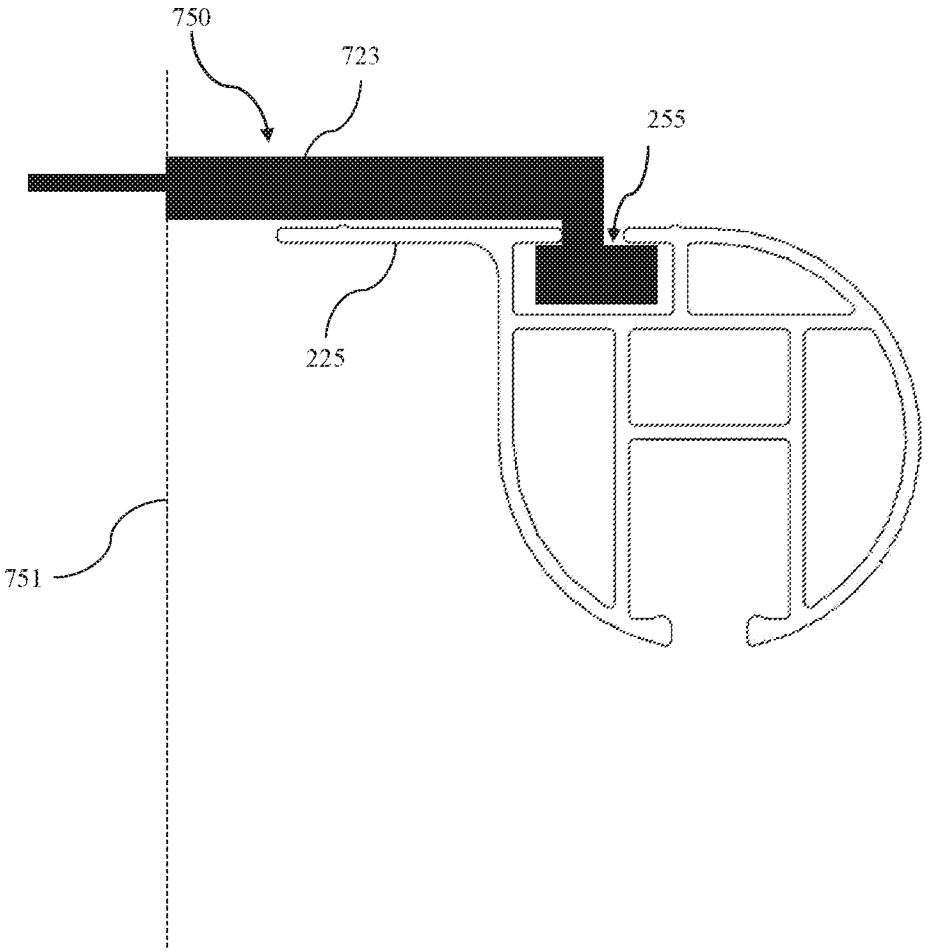
FIG. 8A is an end view of the second decorative mount attached to a wall by a bracket or wall mount, wherein the ends caps are removed, and a channel receives a part of the bracket that is attached to a vertical wall, according to an embodiment of the present invention.

FIG. 8A is an end view of the second decorative mount attached to a wall by a bracket or wall mount 750. In FIG. 8A the ends caps are removed and 255 channel receives a part of the bracket or wall mount that is attached to a vertical wall, according to an embodiment of the present invention. FIG. 8 also illustrates that channel 255 may also be configured for receiving the bracket or wall mount for attaching to the decorative mount to the wall. The brackets or wall mounts illustrated in the figures may be configured such that the brackets or wall mounts slide in to the second channel or third channel (illustrated in FIG. 8, for example). FIG. 8A illustrates the versatility of the present invention in that the lip 225, which is integral with the decorative mount may be mounted to the ceiling, and the second channel 255 may be used for receiving the insulating strip for preventing light leakage (illustrated in FIG. 6A). Additionally, the embodiment illustrated in FIG. 8A may be configured such that the second channel 255 receives a portion of the bracket or wall mount which is attached to vertical wall 751. In the present embodiment illustrated in FIG. 8A, the lip 225 and wall mount are sized so that they do affect the decorative mount being in attachment with the wall.

Figure 9:
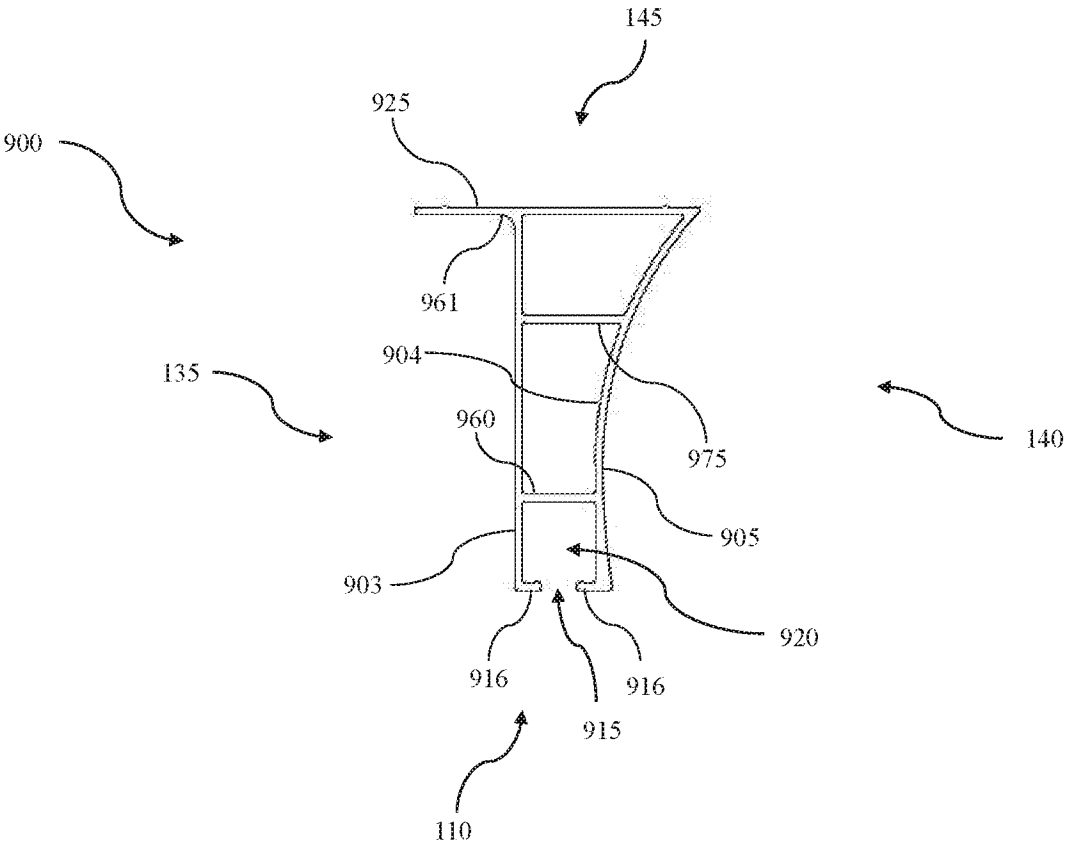
FIG. 9 is an end view of another embodiment of the decorative mount for attaching to a ceiling, having one channel on the downward facing side, wherein the vertical member on the rearward facing side has a flat surface and the vertical member on the frontward facing side has a concave surface, according to an embodiment of the present invention.
Figure 10:
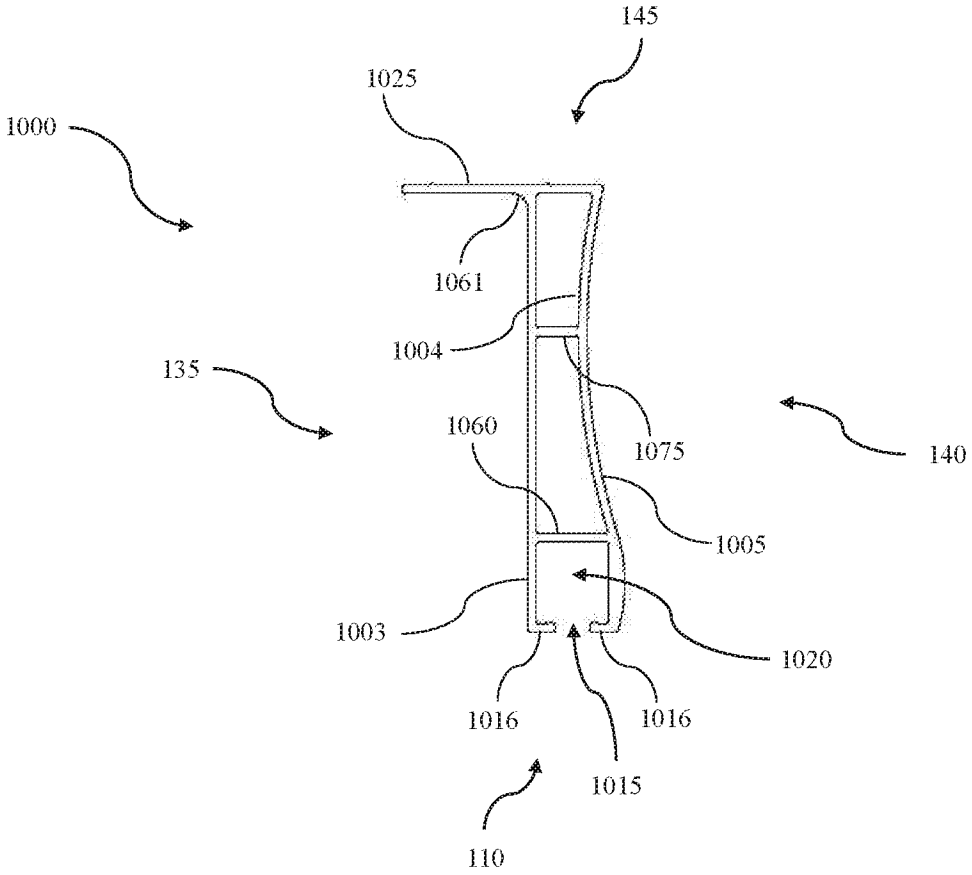
FIG. 10 is an end view of another embodiment of the decorative mount for attaching to a ceiling having one channel on the downward facing side, wherein the vertical member on the rearward facing side has a flat surface and the vertical member on the frontward facing side has a partially concave surface, according to an embodiment of the present invention.

Additional embodiments of the present invention are shown in FIGS. 9 and 10 and will be discussed together. Both figures have an elongated shaped body. The decorative mount comprises a pair of opposing vertical members, wherein the vertical member on the rearward facing side 903, 1003 has a flat surface and the vertical member on the frontward facing side 904, 1004 defines a serpentine type shape, respectively. The decorative mount has two generally planar horizontal cross members 960, 1060 and 975, 1075 that span the vertical members, respectively. Together, the vertical members and cross members define internal partitions that form a longitudinal channel 920, 1020 that extends along the entire length of the decorative mount. The decorative mount has only one opening 915, 1015 located on the downward facing side of the channel and includes two horizontal catching features 916, 1016 configured for receiving and holding a plurality of carriers, respectively. The exterior of the vertical member on the frontward facing side of the decorative mount serves as a decorative surface 905, 1005, respectively. As further shown in FIGS. 9 and 10, the lip 925, 1025 is integral with the top edge 961, 1061 of the decorative mount and configured such that the lip attaches directly to the ceiling and the decorative surface is in a forward facing position, respectively.

Figure 11:
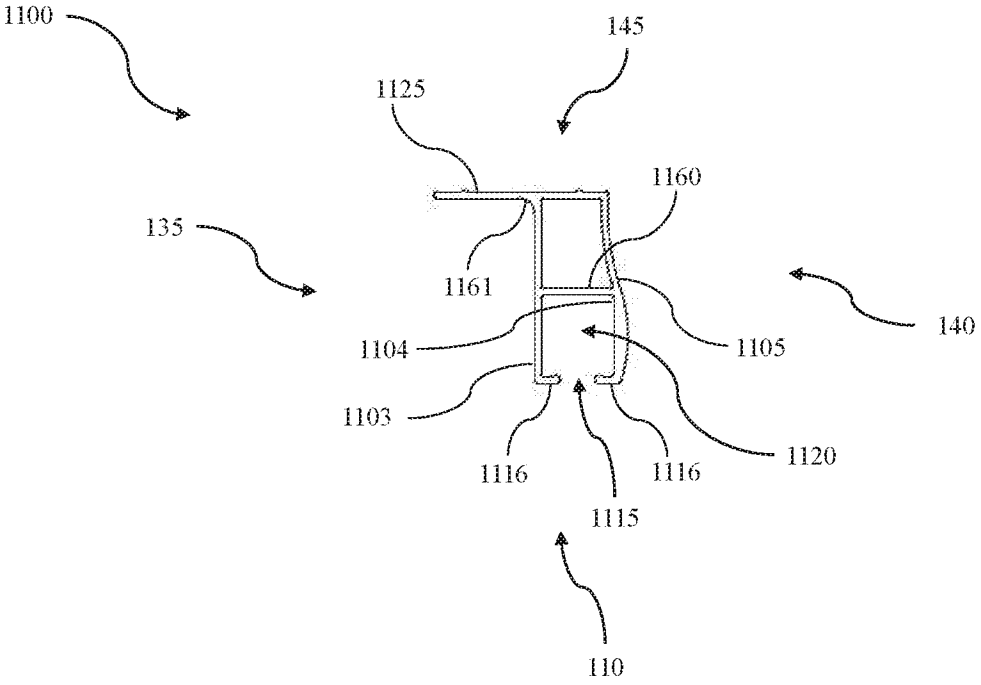
FIG. 11 is an end view of another embodiment of the decorative mount for attaching to a ceiling having one channel on the downward facing side, wherein the vertical member on the rearward facing side has a flat surface and the vertical member on the frontward facing side has a partially concave surface, according to an embodiment of the present invention.

FIG. 11 shows an alternative embodiment of the present invention, wherein the decorative mount 1100 has an elongated shaped body. The decorative mount includes a pair of opposing vertical members, wherein the vertical member on the rearward facing side 1103 has a flat surface and the vertical member on the frontward facing side 1104 has a serpentine type frontward facing surface. The decorative mount has a generally planar horizontal cross member 1160 that spans the vertical members. Together, the vertical members and cross member define internal partitions that form a longitudinal channel 1120 that extends along the entire length of the decorative mount. The decorative mount has an opening 1115 located on the downward facing side of the channel and includes two horizontal catching features 1116 configured for receiving and holding a plurality of carriers. The exterior of the vertical member on the frontward facing side of the decorative mount 1105 serves as a decorative surface. A lip 1125 is integral with the top edge 1161 of the decorative mount and configured such that the lip attaches directly to the ceiling and the decorative surface is in a forward facing position.

Figure 12:
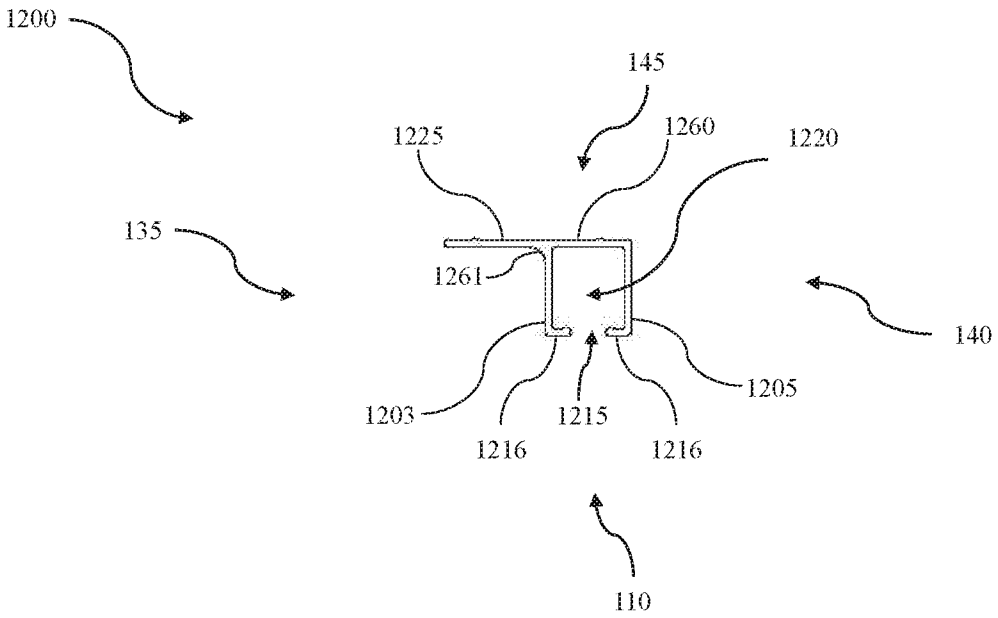
FIG. 12 is an end view of another embodiment of the decorative mount for attaching to a ceiling having one channel on the downward facing side, wherein both vertical members have a flat surface, according to an embodiment of the present invention.

FIG. 12 shows another embodiment of the present invention wherein the decorative mount 1200 has an elongated square shaped body. The decorative mount includes a pair of opposing generally planar vertical members 1203 and a generally planar horizontal cross member 1260 integral with lip 1225 at the top edge 1260 of the decorative mount that spans the vertical members. Together, the vertical members and cross member define a longitudinal channel 1220 that extends along the entire length of the decorative mount. The decorative mount has an opening 1215 located on the downward facing side of the channel and includes two horizontal catching features 1216 configured for receiving and holding a plurality of carriers. The exterior of the vertical member on the frontward facing side of the decorative mount serves as a decorative surface 1205. The lip 1225 is integral with the top edge 1261 of the decorative mount and configured such that the lip attaches directly to the ceiling and the decorative surface is in a forward facing position.

Figure 13:
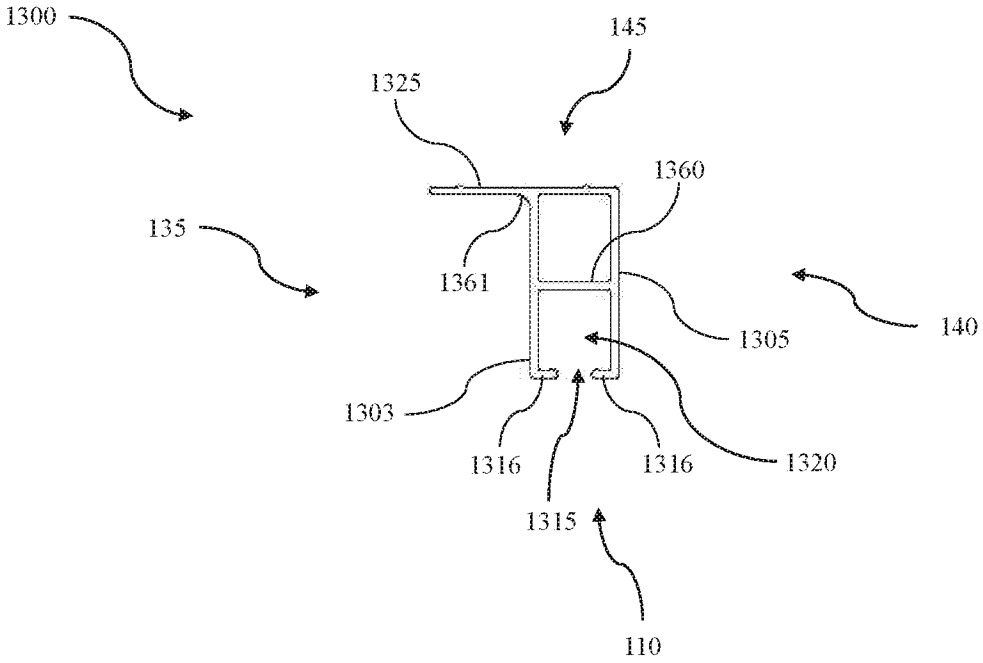
FIG. 13 is an end view of another embodiment of the decorative mount for attaching to a ceiling having one channel on the downward facing side, wherein both vertical members have a flat surface, according to an embodiment of the present invention.
Figure 14:
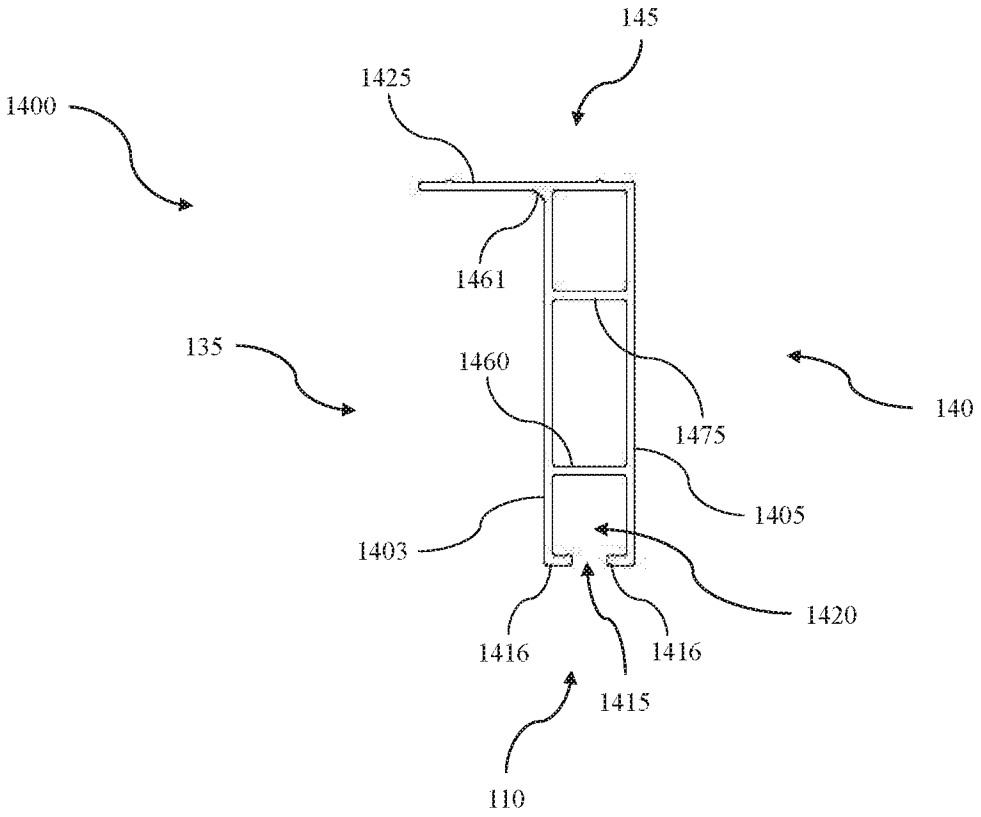
FIG. 14 is an end view of another embodiment of the decorative mount for attaching to a ceiling having one channel on the downward facing side, wherein both vertical members have a flat surface, according to an embodiment of the present invention; and, FIG. 15 is an end view of another embodiment of the decorative mount for attaching to a ceiling mount or wall mount or bracket, wherein the end caps and horizontal lip rearwardly protruding from the top edge of the mount are removed, and a channel is on the upward facing side, and a channel is on the downward facing side.

FIGS. 13 and 14 depict further embodiments of the present invention and will be discussed together. In FIGS. 13 and 14, the decorative mount 1300, 1400 has an elongated rectangular shaped body and includes a pair of opposing generally planar vertical members 1303, 1403, respectively. The decorative mount in FIG. 13 has only one support cross member 1360 that spans the vertical members, whereas the decorative mount in FIG. 14. has two support cross members 1460 and 1475 that span the vertical members. Together, the vertical members and cross member define internal partitions that form a longitudinal channel 1320, 1420 that extends along the entire length of the decorative mount, respectively. As further shown in FIGS. 13 and 14, the decorative mount has only one opening 1315, 1415 located on the downward facing side of the channel and includes two horizontal catching features 1316, 1416 configured for receiving and holding a plurality of carriers, respectively. The exterior of the vertical member on the frontward facing side of the decorative mount serves as a decorative surface 1305, 1405, respectively. The lip 1325, 1425 is integral with the top edge 1361, 1461 of the decorative mount and configured such that the lip attaches directly to the ceiling and the decorative surface is in a forward facing position.

Figure 15:
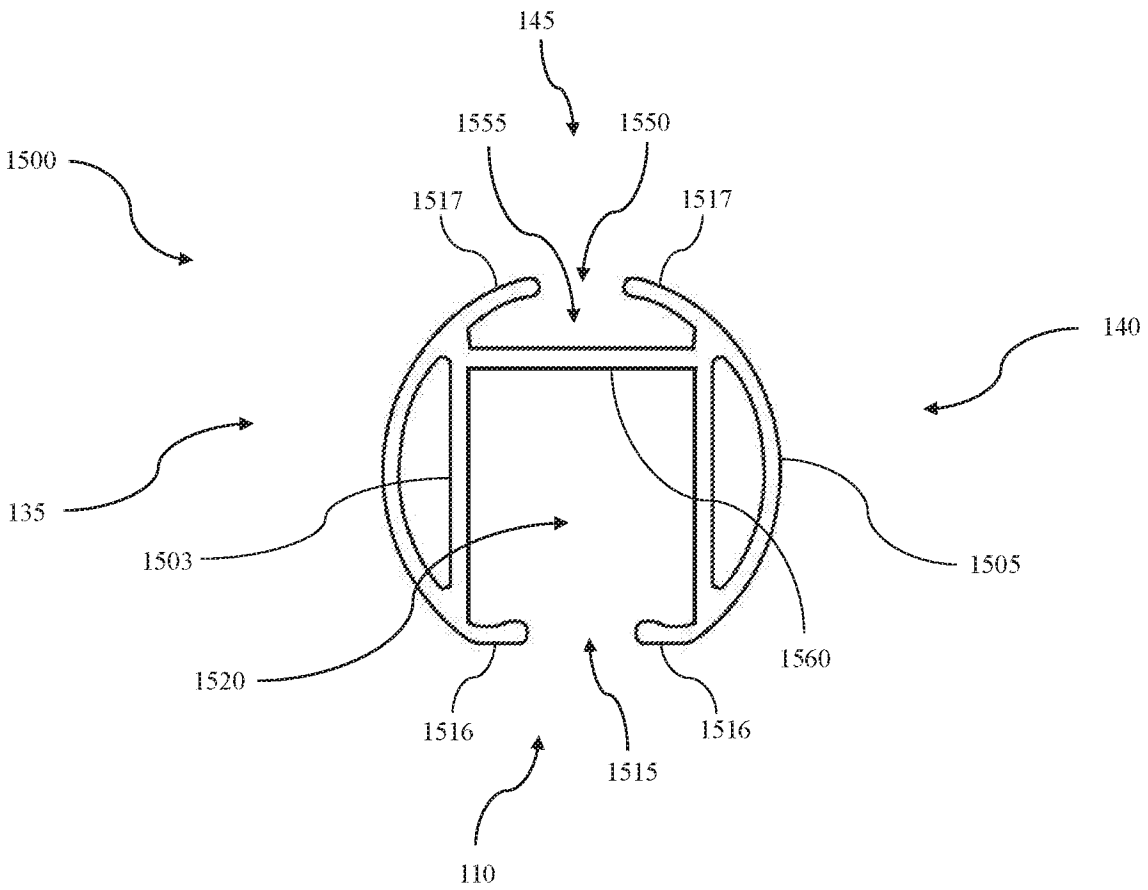

FIG. 15 shows another embodiment of the present invention wherein the decorative mount for attaching to a ceiling is designed without a lip. The decorative mount 1500 has an elongated tubular shaped body. The decorative mount includes a pair of opposing generally planar vertical members 1503 and a generally planar horizontal cross member 1560 spanning the vertical members. Together, the vertical members and cross member define internal partitions that form a longitudinal first channel 1520 that extends along the entire length of the decorative mount. The first opening 1515 is located on the downward facing side of the first channel and includes two horizontal catching features 1516 configured for receiving and holding a plurality of carriers. A decorative surface 1505 of convex shape is positioned on the frontward facing side of the decorative mount. The decorative mount includes a second opening 1550 on the upward facing side of the second channel 1555. The second opening defines a rectangular shape that spans the entire length of the upward facing side of the second channel. The second channel is positioned upward relative to the first channel and has an arc shaped inner frame structure and a substantially semi-circular shaped body that spans the entire length of the decorative mount. The upward end of the second channel includes two curved catching features 1517 configured to receive and hold a bracket to attach the decorative mount to a ceiling or vertical wall. The second channel can be configured for receiving a bracket (similar to the bracket illustrated in FIGS. 7 and 8) or an insulating strip or element (as illustrated in FIG. 6).

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A decorative mount for attaching to a ceiling, the decorative mount comprising a bracket, wherein the bracket comprising:

a pair of opposing vertical members defining a first channel;

a first opening at a downward facing side of the first channel, the first channel for receiving a plurality of carriers;

a support cross member spanning the pair of opposing vertical members above the first channel;

a decorative surface positioned on a frontward facing side of the bracket; and, a lip horizontally aligned along a rearward facing top edge of the bracket, wherein the lip is integral with a top of the bracket and defines a mounting surface, wherein the mounting surface is configured for receiving a fastener that attaches the lip to the ceiling such that at least a portion of the lip abuts the ceiling and the decorative surface faces frontward;

a second opening above an upward side of and providing access to a second channel, wherein the second channel is positioned upward relative to the first channel; and, an insulating strip having a first part and a second part, wherein the first part is mounted in the second opening and wherein the second part of the insulating strip is higher than an upward facing side of the mounting surface.

2. The decorative mount from claim 1, wherein the second part of the insulating strip abuts the ceiling when the bracket is attached to the ceiling by the fastener thereby preventing light leakage between an uneven ceiling and the upward facing side of the bracket.

3. The decorative mount from claim 1, wherein the insulating strip comprises at least one of a polyester filament, polyvinyl chloride, natural rubber, synthetic rubber, foam, synthetic fabrics, acrylic filament, nylon, rayon and any combination thereof.

4. The decorative mount from claim 1, wherein the decorative mount further comprises a third opening at the upward side of a third channel, wherein the third channel is positioned upward relative to the first channel and rearward relative to the second channel.

5. The decorative mount from claim 4, wherein the second channel is configured to receive a first part of a bracket configured to attach the decorative mount to the wall.

6. The decorative mount of claim 1, wherein the lip defines a first ridge wherein a portion of the first ridge abuts a downward facing surface of the ceiling when the bracket is attached to the ceiling by the fastener thereby preventing light leakage between the ceiling and the upward facing side of the bracket.

7. The decorative mount of claim 6, wherein a second ridge is positioned frontward relative to the second opening.

8. A decorative mount for attaching to a ceiling, the decorative mount comprising a bracket, wherein the bracket comprising:

a pair of opposing vertical members defining a first channel;

a first opening at a downward facing side of the first channel, the first channel for receiving a plurality of carriers;

a support cross member spanning the pair of opposing vertical members above the first channel;

a decorative surface positioned on a frontward side of the bracket;

a second opening above an upward side of and providing access to a second channel, wherein the second channel is positioned upward relative to the first channel;

an insulating strip having a first part and a second part, wherein the first part is mounted in the second opening and wherein the second part of the insulating strip is higher than the second opening, wherein the insulating strip abuts the ceiling when the bracket is attached to the ceiling thereby preventing light leakage between the ceiling and an upward facing side of the bracket.

9. The decorative mount of claim 8, wherein the bracket further comprises a lip, wherein the lip having a mounting surface, wherein the mounting surface defines a hole and has a fastener extending through the mounting surface such that the fastener attaches the lip to the ceiling such that at least a portion of the lip abuts the ceiling and the decorative surface faces frontward.

10. The decorative mount from claim 9, wherein the decorative mount further comprises a third opening at the upward side of a third channel, wherein the third channel is positioned upward relative to the first channel and rearward relative to the second channel.

11. The decorative mount from claim 10, wherein the third channel is configured to receive a first part of a bracket configured to attach the decorative mount to the wall.

12. The decorative mount of claim 9, wherein the lip defines a first ridge wherein at least a portion of the first ridge abuts a downward facing surface of the ceiling when the bracket is attached to the ceiling by the fastener thereby preventing light leakage between the ceiling and the upward facing side of the bracket.

13. The decorative mount of claim 12, wherein a second ridge is positioned frontward relative to the second opening.

* * * * *